US007697858B2

(12) United States Patent
Moon et al.

(10) Patent No.: US 7,697,858 B2
(45) Date of Patent: Apr. 13, 2010

(54) IMAGE FORMING APPARATUS

(75) Inventors: Ji-won Moon, Suwon-si (KR); Won Choe, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 198 days.

(21) Appl. No.: 11/835,585

(22) Filed: Aug. 8, 2007

(65) Prior Publication Data

US 2008/0187366 A1 Aug. 7, 2008

(30) Foreign Application Priority Data

Feb. 6, 2007 (KR) ..... 10-2007-0012220

(51) Int. Cl.
*G03G 15/08* (2006.01)

(52) U.S. Cl. ..... 399/53; 399/261

(58) Field of Classification Search ..... 399/53, 399/252, 258, 261, 58

See application file for complete search history.

(56) References Cited

U.S. PATENT DOCUMENTS

2004/0184841 A1 9/2004 Tsuda et al.

FOREIGN PATENT DOCUMENTS

| | | | |
|---|---|---|---|
| JP | 2-226266 | | 9/1990 |
| JP | 04174467 A | * | 6/1992 |
| JP | 4-299374 | | 10/1992 |
| KR | 2004-94368 | | 9/2004 |

* cited by examiner

*Primary Examiner*—David M Gray
*Assistant Examiner*—Gregory H Curran
(74) *Attorney, Agent, or Firm*—Stanzione & Kim, LLP

(57) ABSTRACT

An image forming apparatus includes a developer storage tank which stores a developer therein and has a developer discharger to discharge the developer therethrough, a developer receiver which receives the developer, a delivery member which is connected with the developer discharger and delivers the developer to the developer receiver through a delivery path, and a vibrator which vibrates the delivery member.

22 Claims, 10 Drawing Sheets

IMAGE FORMING APPARATUS

CROSS-REFERENCE TO RELATED APPLICATIONS

This application claims priority from Korean Patent Application No. 10-2007-0012220, filed on Feb. 6, 2007, in the Korean Intellectual Property Office, the disclosure of which is incorporated herein by reference.

BACKGROUND OF THE INVENTION

1. Field of the Invention

The present general inventive concept relates to an image forming apparatus, and more particularly, to an image forming apparatus which improves developer supply configuration.

2. Description of the Related Art

An electrophotograhic image forming apparatus forms an image on a printing medium through charging, exposing, developing, transferring and fixing processes. The electrophotograhic image forming apparatus includes a laser printer, a photocopier, a multifunction printer, etc.

As illustrated in FIG. 1, one of the developer supply methods of a conventional image forming apparatus includes an integrated type where a developer storage part 8 storing a developer T and a developing part 3 developing a printing medium are integrally provided inside a casing 2. The other developer supply method of the conventional image forming apparatus includes a separate type where a developer storage tank 10 and a developing unit 20 are separated from each other, as illustrated in FIG. 2.

In the case of the integrated type, a plurality of agitators 9*a* and 9*b* are provided in the developer storage part 8 to prevent the developer T from being clotted and to supply the developer T to a supplying roller 7 provided therebelow. The supplying roller 7 frictionally charges the developer T and supplies it to a developing roller 5. A doctor blade 6 controls the thickness of the developer T attached to a surface of the developing roller 5, thereby developing an electrostatic latent image of a photosensitive drum 4.

In the case of the separate type, the developer T stored in the developer storage tank 10 is supplied to the developing unit 20 through a developer supplying pipe 30. An agitator 13 is provided in the developer storage tank 10 to move the developer T to the developer supplying pipe 30.

The developer T moves along the developer supplying pipe 30 and is supplied to a developer receiver 23 of the developing unit 20. Then, the developer T is supplied from the developer receiver 23 to a supplying roller 26 within a unit casing 21 by the agitator 13 which rotates along a rotating axis thereof. The supplying roller 26 frictionally charges the supplied developer T and supplies it to a developing roller 27.

However, in the conventional separate type developer supplying method, if a user does not print for a long period of time, the developer T becomes adhered to the developer supplying pipe 30, and thus is not smoothly supplied to the developing unit 20. Then, image density becomes non-uniform, and printing quality is lowered.

SUMMARY OF THE INVENTION

The present general inventive concept provides an image forming apparatus which employs a separate type developer supplying method to supply a developer with simplicity and consistency.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus, including: a developer storage tank which stores a developer therein and has a developer discharger to discharge the developer therethrough; a developer receiver which receives the developer; a delivery member which is connected with the developer discharger and delivers the developer to the developer receiver through a delivery path; and a vibrator which vibrates the delivery member.

The image forming apparatus may further include a developing unit which develops a printing medium with the developer supplied to the developer receiver.

The developing unit may also include: a unit casing; and a developing roller which is accommodated in the unit casing and develops the printing medium.

The developer receiver can be integrally formed in the unit casing.

The delivery member may include a soft deformer which has a soft material and is deformed by an external force.

The vibrator vibrates the soft deformer.

The soft deformer can include rubber or soft plastic.

The delivery member can include a hard part which has a hard material and is connected with either the developer discharger or the developer receiver.

The delivery path can be formed as a straight line.

The delivery member can be detachably attached to the developer receiver and the developer discharger respectively.

The vibrator can include: an actuator which moves between a contact position to contact and actuate the delivery member and a separation position to be spaced from the delivery member; and an actuator driver which drives the actuator.

The actuator can include a cam.

The actuator can include a rack.

The vibrator can include an actuator which moves between a contact position to contact and actuate the delivery member and a separation position to be spaced from the delivery member; and an actuator driver which drives the actuator.

The image forming apparatus can further include a developer amount detector which is provided in the unit casing and detects the amount of the developer stored therein; and a controller which controls the actuator driver to position the actuator in the separation position if the unit casing is full of the developer.

The controller can control the actuator driver to periodically position the actuator in the contact position if a user commands to print.

The vibrator can vibrate the delivery member to reciprocate in a lengthwise direction.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1:
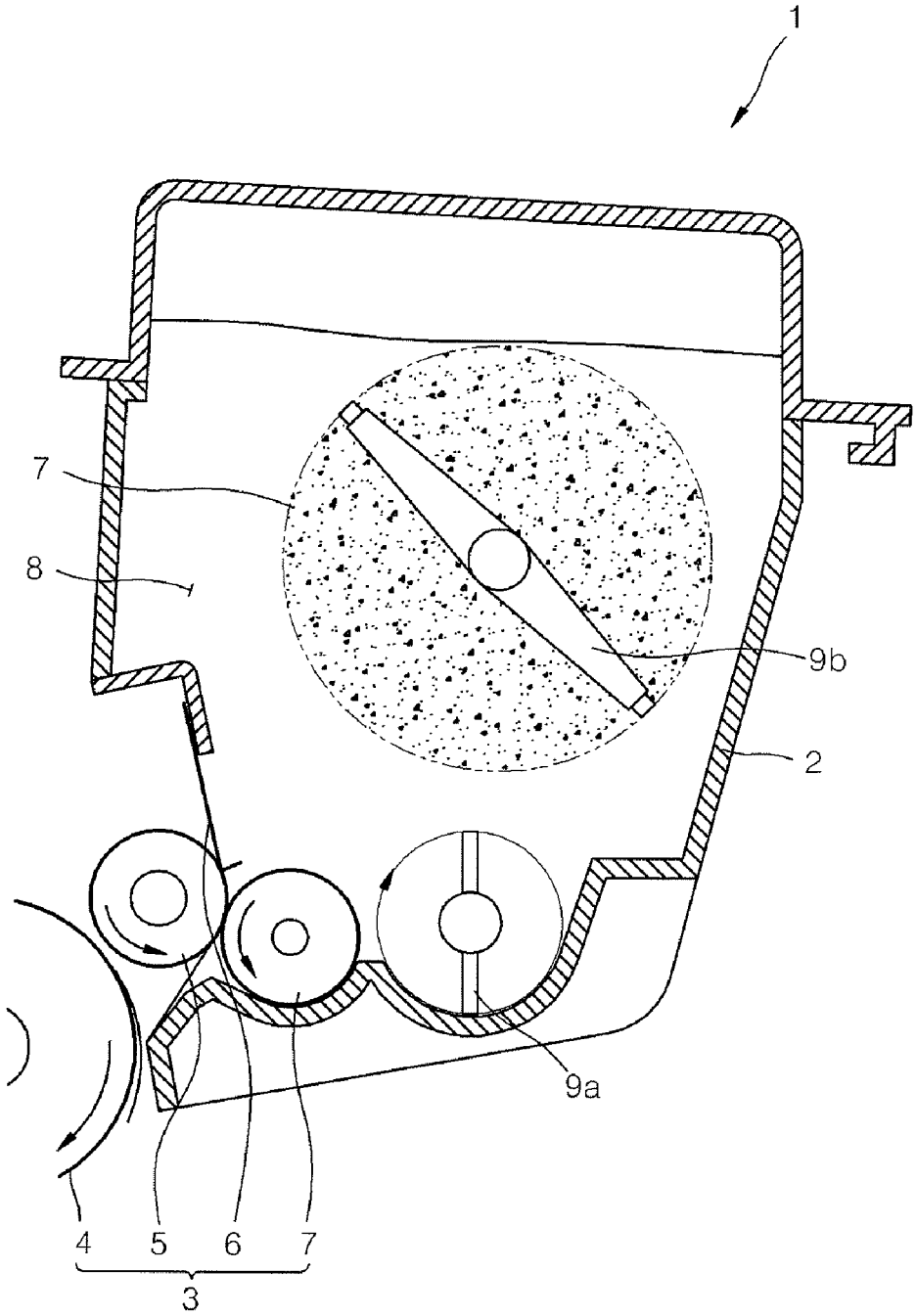
FIG. 1 (RELATED ART)
FIG. 1 is a schematic view of a conventional integrated type developer supplying method.
Figure 2:
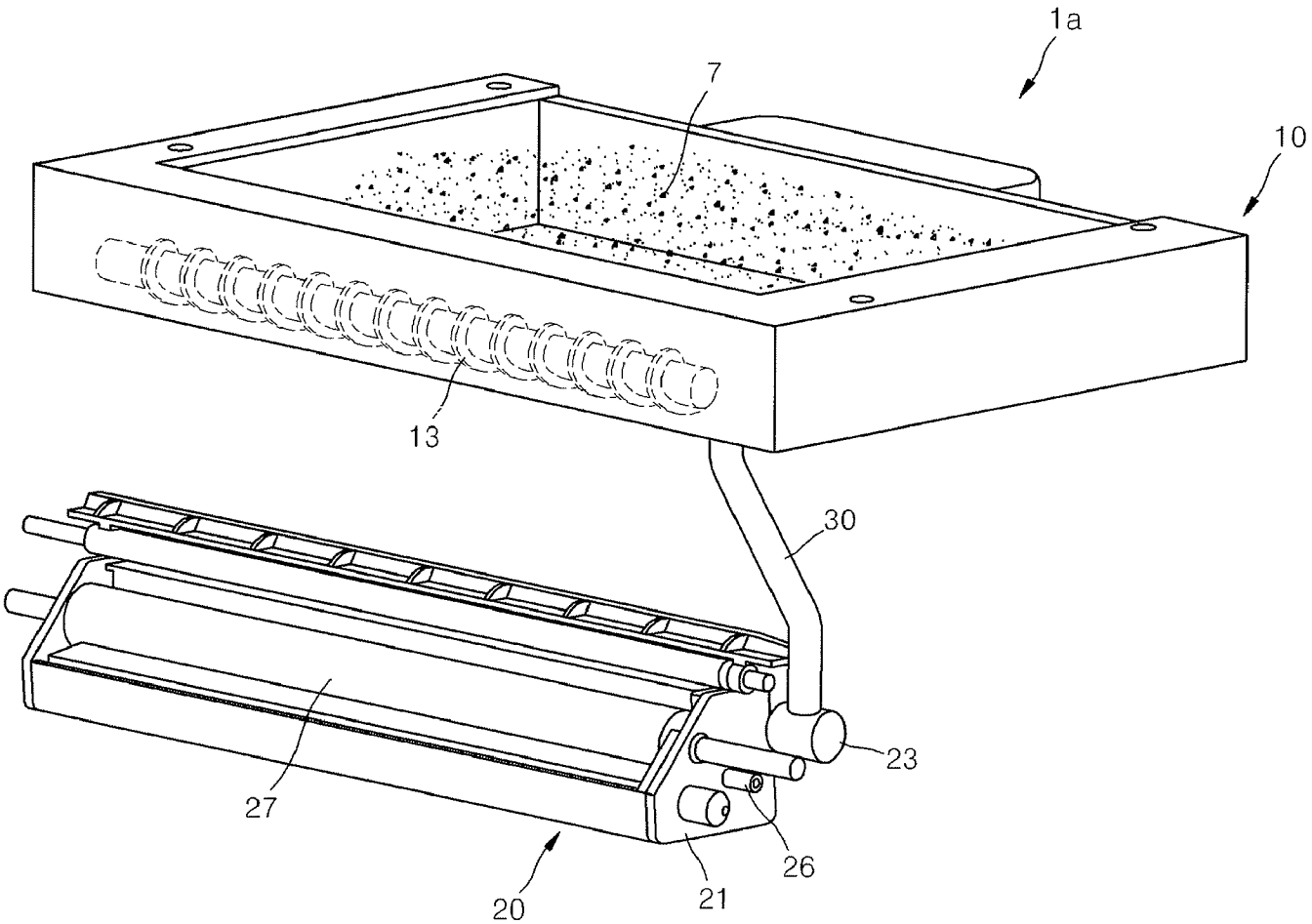
FIG. 2 (RELATED ART)
FIG. 2 is a schematic view of a conventional separate type developer supplying method.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
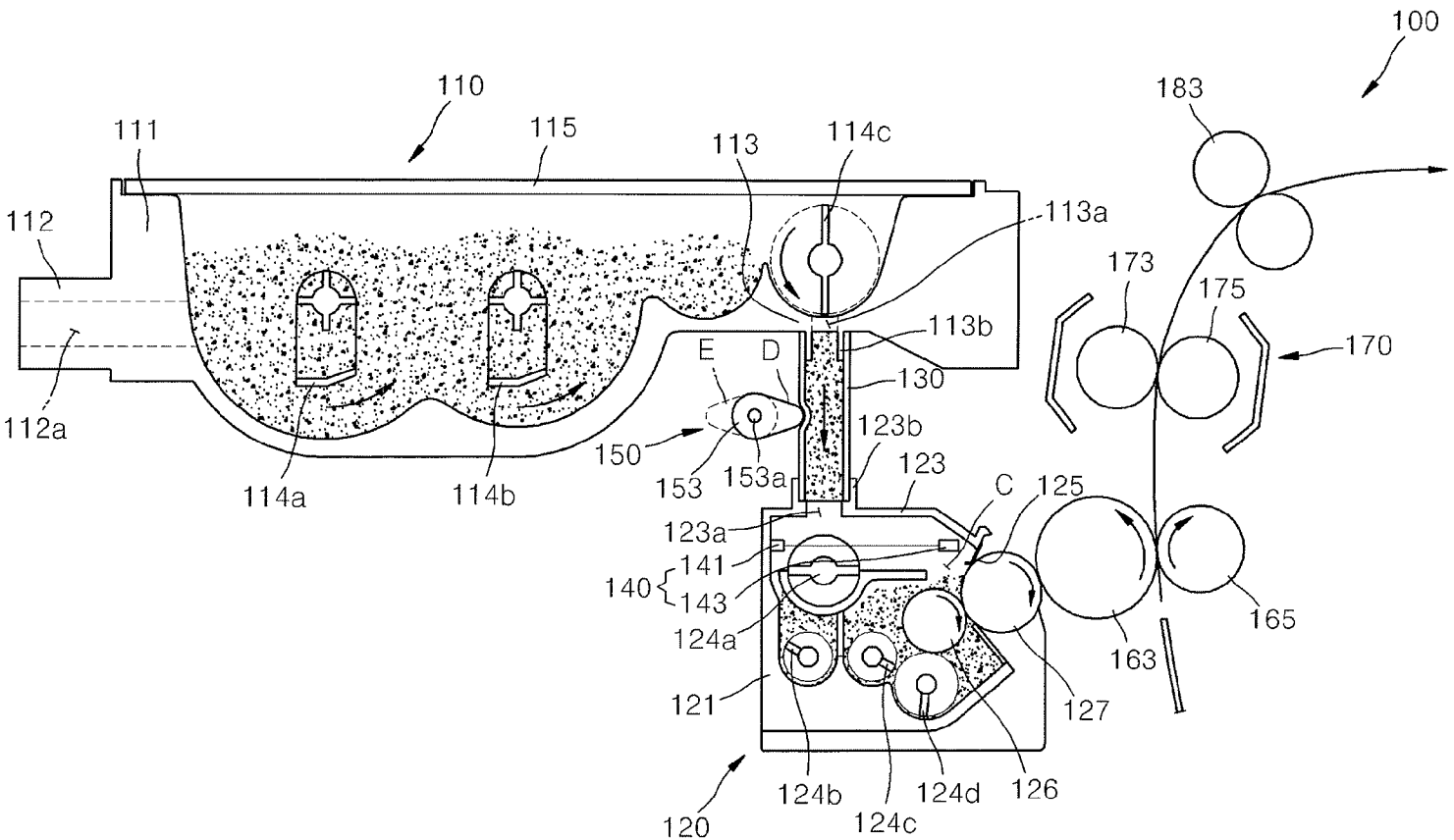
FIG. 3 is a schematic view of an image forming apparatus according to an exemplary embodiment of the present general inventive concept.
Figure 4:
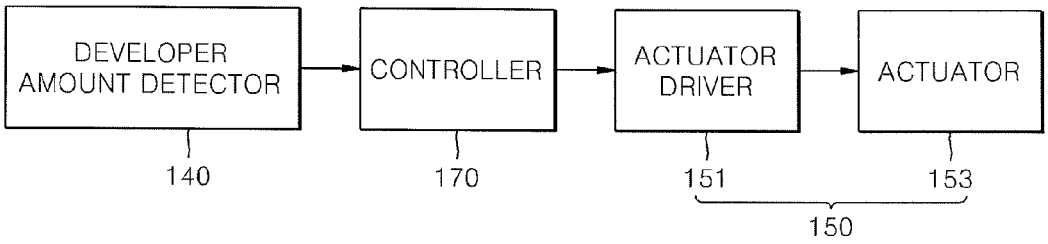
FIG. 4 is a block diagram of the image forming apparatus in FIG. 3.

As illustrated in FIGS. 3 and 4, an image forming apparatus 100 according to an exemplary embodiment includes a developer storage tank 110, a developing unit 120, a delivery member 130 which delivers a developer stored in the developer storage tank 110 to a developer receiver 123, and a vibrator 150 which vibrates the delivery member 130.

The developer storage tank 110 may include a tank main body 111, a developer injector 112, a plurality of agitators 114*a*, 114*b* and 114*c*, a cover 115 and a developer discharger 113.

The developer storage tank 110 is detachably attached to a main body (not illustrated) of the image forming apparatus 100. If the developer runs out, the developer storage tank 110 is detached therefrom to refill the developer, and then attached thereto again.

The developer injector 112 includes a developer injection hole 112*a* through which the developer is injected to the developer storage tank 110. The developer injector 112 may protrude from the tank main body 111.

The plurality of agitators 114*a*, 114*b* and 114*c* moves the developer within the tank main body 111 toward the developer discharger 113, and mixes the developer to avoid clotting.

The developer discharger 113 may include a developer outlet 113*a* which is provided in a side of the tank main body 111, and a projection 113*b* which extends from the developer outlet 113*a* to the outside of the tank main body 111.

The agitator 114*c* may include a helical blade (not illustrated) to move the developer toward the developer outlet 113*a*.

The delivery member 130 delivers the developer which is discharged by the developer discharger 113 to the developer receiver 123 along a delivery path. A first end part of the delivery member 130 may be connected with the projection 113*b* of the developer discharger 113 while a second end part thereof may be connected with the developer receiver 123 of the developing unit 120. As illustrated in FIG. 3, the delivery path may be provided as a straight line. Alternatively, the delivery path may be provided as a curved line in consideration of the arrangement of the developer discharger 113 and the developer receiver 123.

The delivery member 130 may have a cylindrical shape. The delivery member 130 may have various shapes as long as it has a path to deliver the developer therethrough.

The delivery member 130 may include a soft material such as rubber and soft plastic. Thus, the delivery member 130 may connect the developer discharger 113 and the developer receiver 123 even if the positions of the developer discharger 113 and the developer receiver 123 are changed. Also, the vibration of the vibrator 150 (to be described later) may be easily transmitted to the delivery member 130 in a lengthwise direction thereof.

The vibrator 150 may include an actuator 153 which actuates the delivery member 130, and an actuator driver 151 which drives the actuator 153. As illustrated in FIG. 3, the actuator 153 may move between a contact position D to contact and actuate the delivery member 130 and a separation position E to be spaced from the delivery member 130.

The actuator 153 may include a cam, and rotate around a cam shaft 153*a* to move between the contact position D and the separation position E, thereby actuating the delivery member 130. Thus, the developer which may adhere to the delivery member 130 due to long printing suspension or environmental printing conditions such as high temperature and moisture or low temperature and moisture, is actuated to fall down to a developing chamber C. Thus, the developer is supplied with simplicity and consistency.

The actuator driver 151 may include a typical driving means such as an electric driving motor.

The developing unit 120 includes a unit casing 121, the developer receiver 123 which is connected with the delivery member 130 and receives the developer therefrom, a plurality of agitators 124*a*, 124*b*, 124*c* and 124*d*, a doctor blade 125, a supplying roller 126 and a developing roller 127.

As illustrated in FIG. 3, the developer receiver 123 is integrally formed in the unit casing 121, but not limited thereto. Alternatively, the developer receiver 123 may be additionally manufactured to be connected with the unit casing 121.

The developer receiver 123 includes a projection 123*b* which protrudes toward the developer storage tank 110, and a developer inlet 123*a* which is formed in the projection 123*b* to receive the developer from the delivery member 130. A diameter of the developer inlet 123*a* is smaller than that of the delivery member 130 to connect an end part of the delivery member 130 with the developer inlet 123*a* by a press fit. Otherwise, an internal diameter of the delivery member 130 is smaller than an external diameter of the projection 123*b* so that the end part of the delivery member 130 is connected with the external circumference surface of the projection 123*b* by a press fit.

The plurality of agitators 124*a*, 124*b*, 124*c* and 124*d* is provided in the unit casing 121 to supply the developer from the developer receiver 123 to the supplying roller 126. The number, shape and arrangement of the agitators 124*a*, 124*b*, 124*c* and 124*d* may be determined in consideration of the position of the developing chamber C and the supplying roller 126.

The supplying roller 126 rotates in the same direction as the developing roller 127 to frictionally charge the developer. The charged developer is attached to the external circumference surface of the developing roller 127 and controlled by the doctor blade 125 in a predetermined thickness.

The developing roller 127 develops an electrostatic latent image on a photosensitive body 163 with the developer having the controlled thickness. Thus, a developer visible image including the developer is formed on a surface of the photosensitive body 163.

The developer visible image is transferred to a printing medium P which passes between the photosensitive body 163 and a transfer roller 165. The developer visible image transferred to the printing medium P passes a fixing unit 170 having a heat roller 173 and a press roller 175, to be fixed on the printing medium P by heat and pressure.

The printing medium P where the printing image has been fixed by the fixing unit 170 is discharged to the outside through a paper discharging roller 183, thereby completing a printing process.

An imaging drum (not illustrated) which has a plurality of electrodes on an external circumference surface thereof may be used instead of the photosensitive body 163 which is applied with a photosensitive material and exposed to light so that electric charge moves. U.S. Pat. No. 4,704,621 discloses an image forming method with an imaging drum. Since a plurality of relating patents is being filed, the detailed description thereof will be avoided here.

As illustrated in FIGS. 3 and 4, the image forming apparatus 100 according to an exemplary embodiment may further include a developer amount detector 140 which detects the amount of the developer supplied in the developing chamber C of the unit casing 121, and a controller 170 which controls the vibrator 150 according to a detection signal of the developer amount detector 140.

As illustrated in FIG. 3, the developer amount detector 140 may detect whether the developer is fully stored in the developing chamber C. The developer amount detector 140 may include a light sensor which has a light emitter 143 provided in an upper part of the developing chamber C and to emit light, and a light receiver 141 provided in the upper part of the developing chamber C and to receive light emitted by the light emitter 143. The developer amount detector 140 may include a pressure sensor to sense the weight of the developing unit 120, as necessary.

The controller 170 may determine that the developer is fully stored in the developing chamber C if a light signal of the light emitter 143 is not detected from signals outputted by the light receiver 141. If the developer amount detector 140 includes a pressure sensor, the controller 170 may determine whether the developer is fully stored in the developing chamber C by comparing the current weight with a weight of the developing unit 120 having the developing chamber C full of the developer.

If the developer is fully stored in the developing chamber C, the controller 170 controls the actuator driver 151 to position the actuator 153 in the separation position E. As the developer is not being smoothly supplied to the developing chamber C, the developing chamber C is prevented from being saturated with the developer. If it is determined that the developer is fully stored in the developing chamber C, the controller 170 may stop operating the agitator 114*c* adjacent to the developer discharger 113 within the developer storage tank 110 to reduce the amount of the developer supplied to the developing chamber C.

If a user commands to print, the controller 170 may control the actuator driver 151 so that the actuator 153 periodically actuates the delivery member 130. Then, the developing chamber C can be filled with new developer by as much as the used amount. As a result, the amount of the developer is maintained to be relatively constant in the developing chamber C, thereby realizing printing quality with uniform density.

Figure 5:
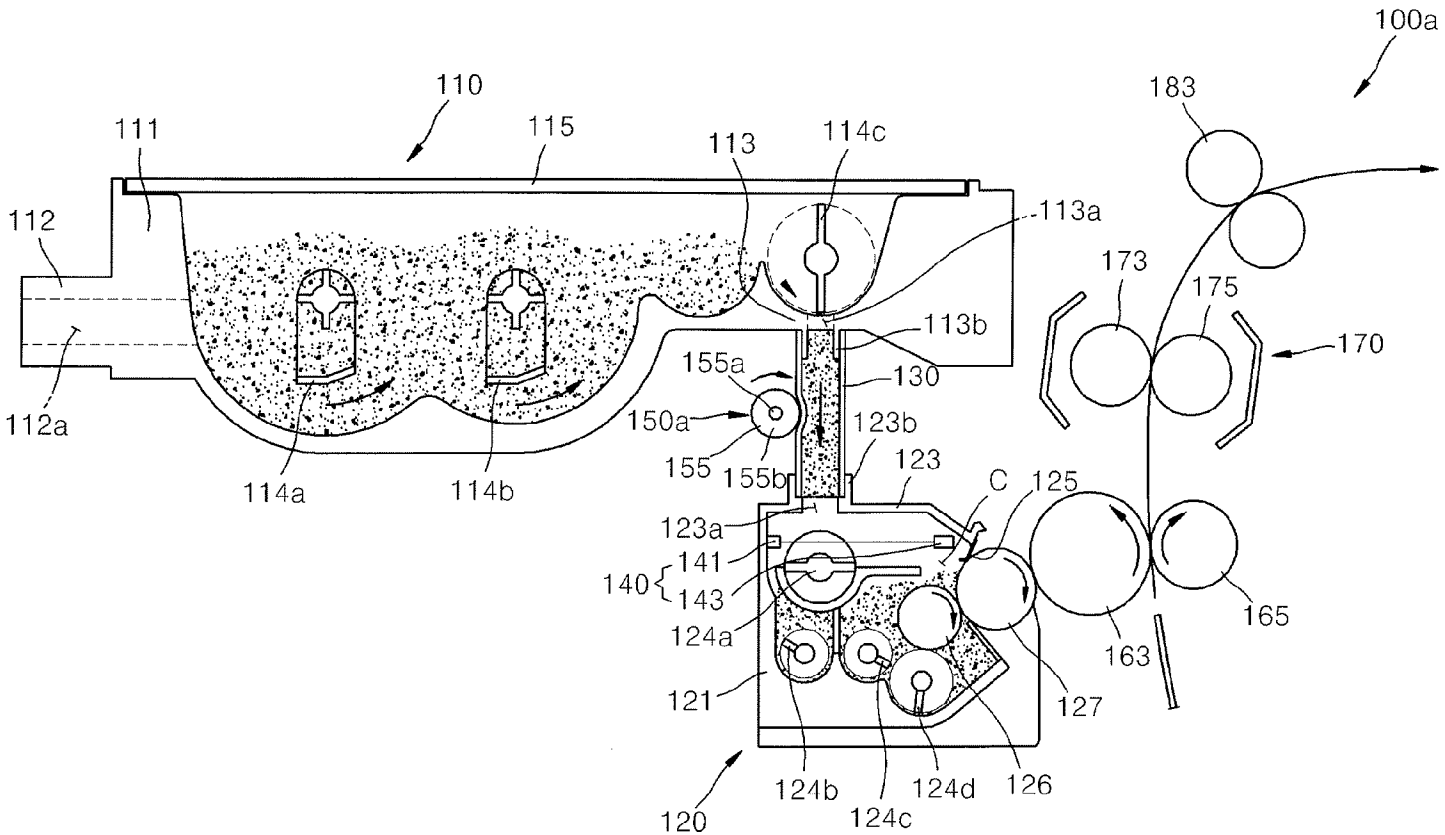
FIG. 5 is a schematic view of an image forming apparatus according to another exemplary embodiment.

As illustrated in FIG. 5, an image forming apparatus 100*a* according to another exemplary embodiment includes a vibrator 150*a*.

The vibrator 150*a* includes an actuator 155 which rotates in contact with a delivery member 130 to actuate the delivery member 130, and an actuator driver (not illustrated) which drives the actuator 155. Other elements are the same as those in the previous exemplary embodiment. Thus, the detailed description will be avoided here.

As illustrated in FIG. 5, the actuator 155 may include a rotating roller which has a surface layer 155*b* surrounding a rotating shaft 155*a* and having an elastic material. The rotating shaft 155*a* is adjacent to the delivery member 130 so that the surface layer 155*b* contacts the delivery member 130 at all times. The rotation direction of the actuator 155 is not limited to that as illustrated in FIG. 5. Alternatively, the actuator 155 may rotate in an opposite direction or alternately rotate clockwise or counterclockwise. The rotation direction of the actuator 155 may vary as long as it actuates the delivery member 130.

The delivery member 130 includes a soft material such as rubber to be deformed and actuated by the rotation of the actuator 155.

A controller (not illustrated) cuts off power supplied to the actuator driver and stops actuating the actuator 155 if it is determined by a developer amount detector 140 that a developing chamber C is full of the developer. As the delivery member 130 is not actuated by the actuator 155, the amount of the developer supplied to the developing chamber C through the delivery member 130 may be reduced.

Before the developing chamber C is full of the developer, or if a user commands to print, the controller may control to supply power to the actuator driver to drive the actuator 155. Then, the developer is supplied to the developing chamber C without difficulty.

The controller may drive the actuator 155 together with driving of a developing roller 127 without the developer amount detector 140. That is, the actuator 155 may operate or stop operating as the developing roller 127 operates or stops operating.

Figure 8:
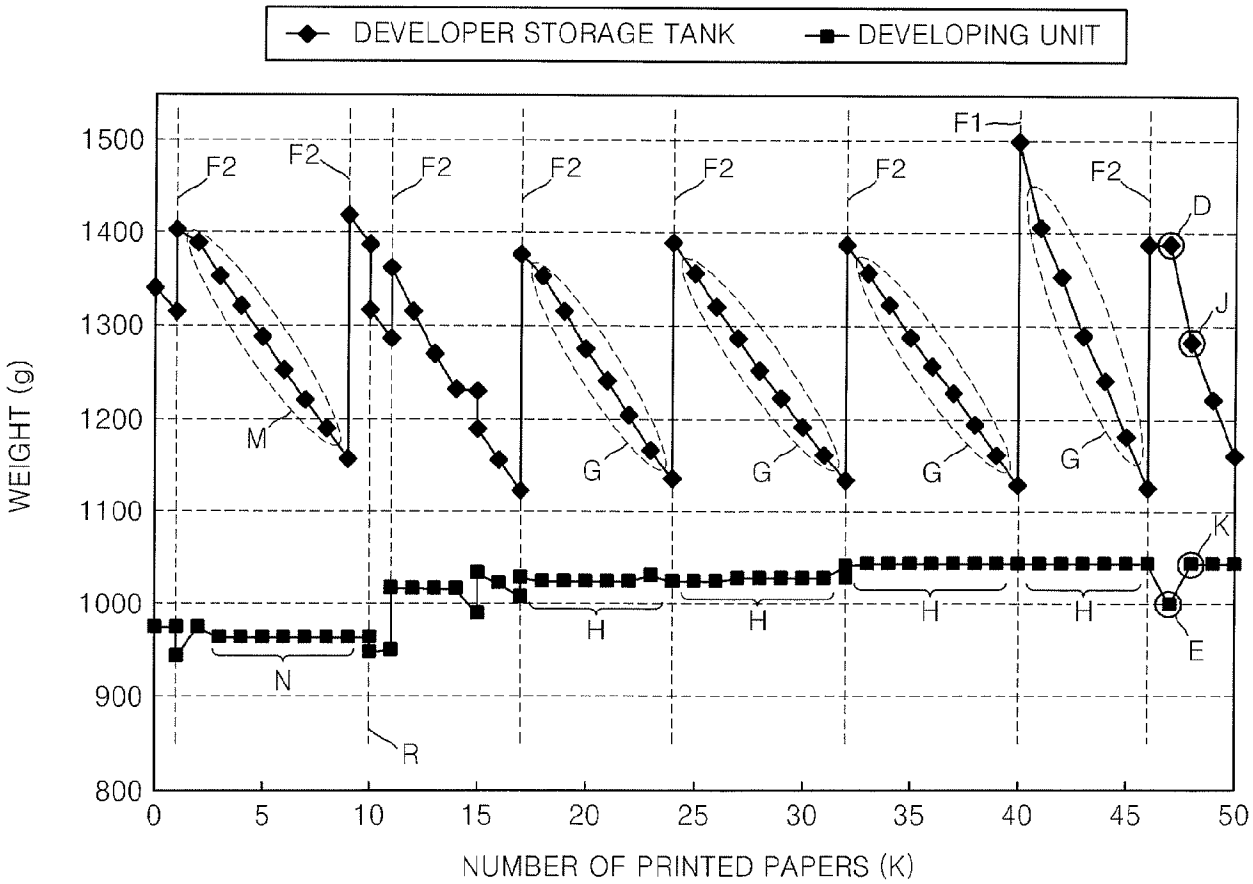
FIG. 8 is a graph which illustrates a printing test result of the image forming apparatus in FIG. 5.

FIG. 8 is a graph which illustrates weight in grams of a developer storage tank 110 and a developing unit 120 in printing every 1,000 sheets of paper until 50,000 sheets of paper are printed by the image forming apparatus 100*a* according to the present exemplary embodiment. The actuator 155 is driven together with the driving of the developing roller 127 of the developing unit 120 during the printing operation. The experiment can then be implemented without the developer amount detector 140.

The developer is added to the developer storage tank 110 at time F2 and time F1, and the developer storage tank 110 is replaced at time R.

On the assumption that the developer is adhered to the delivery member 130 due to printing environmental factors (temperature, humidity, printing time, etc.) to clog the developer delivery path, the weight of the developing unit 120 is measured after 1,000 sheets of paper are printed while a developer outlet 113*a* is blocked. As illustrated at E in FIG. 8, the weight of the developing unit 120 drastically reduces at time D according to the consumption of the developer in the developing chamber C. If 1,000 sheets of paper are printed (refer to J in FIG. 8) while the developer outlet 113*a* is open, the developing unit 120 is restored to its original weight (refer to K in FIG. 8).

At normal states G and M at which the developer outlet 113*a* is open, the weight of the developing unit 120 is constant as illustrated at H and N in FIG. 8. Supposedly, the weight of the developing unit 120 increases from N to H at time R at which 10,000 sheets of paper are printed, due to the replacement of the developer storage tank 110.

The weight of the developing unit 120 is almost constant regardless of whether the developer is significantly added to the developer storage tank 110 at time F1 and not significantly added thereto at time F2. That is, the amount of the developer supplied to the developing chamber C through the delivery member 130 is almost constant regardless of the amount of the developer stored in the developer storage tank 110.

As illustrated in FIG. 8, it is assumed from the constant weight of the developing unit 120 that the amount of the developer stored in the developing chamber C is also constant. That is, the amount of the developer is constantly maintained within the developing chamber C if the delivery member 130 is actuated by the actuator 155 together with the driving of the developing roller 127 of the developing unit 120. Thus, the developer amount detector 140 may be removed.

As illustrated, the developer is smoothly supplied to the developing chamber C through the delivery member 130 regardless of the amount of the developer stored in the developer storage tank 110 and printing environment (temperature, humidity, and the number of printing paper). As the amount of the developer supplied to the developing chamber C is relatively constant, the amount of the developer stored in the developing chamber C is constant.

Thus, printing quality which has relatively uniform density remains constant regardless of environmental factors.

Figure 6:
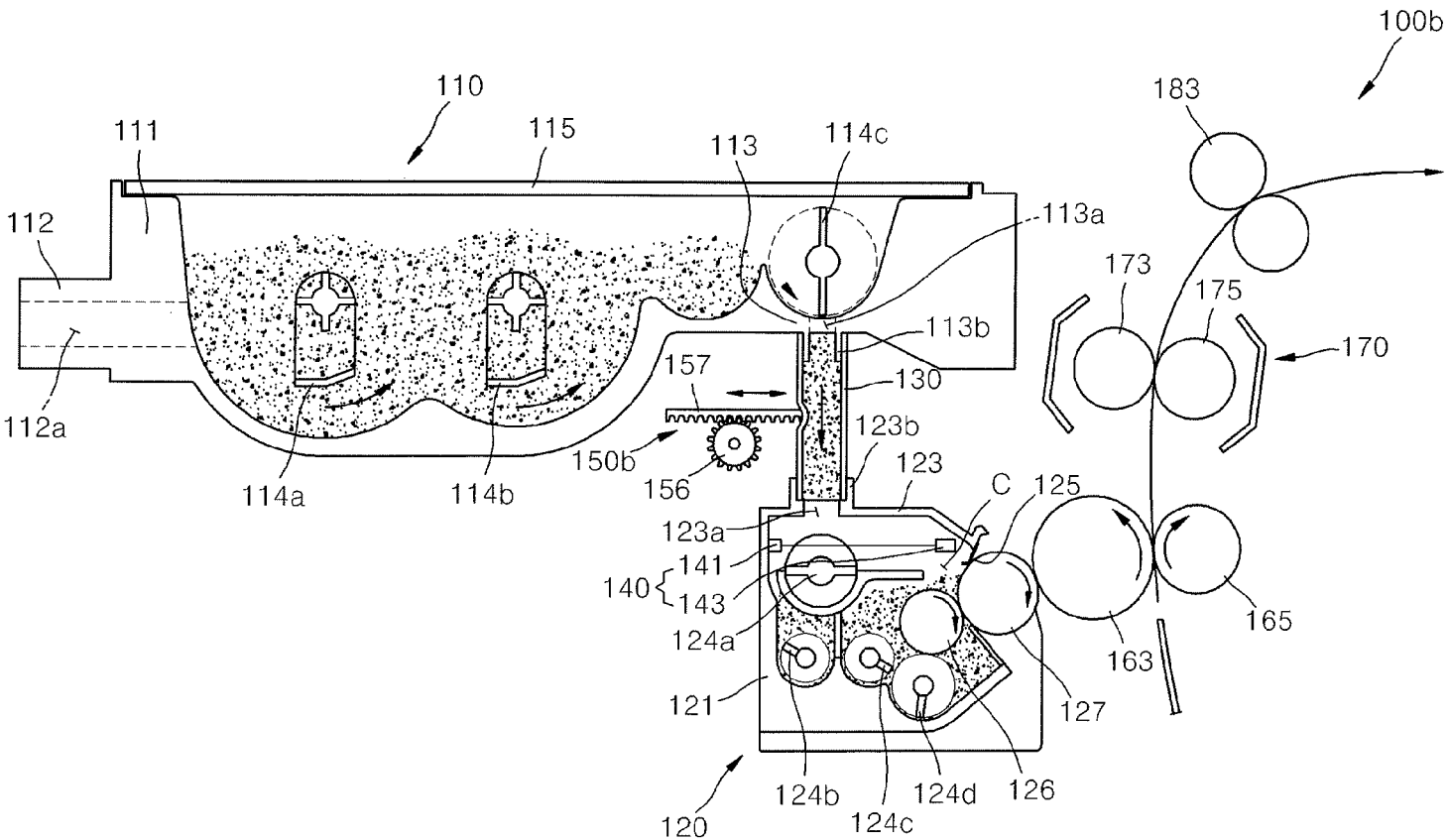
FIG. 6 is a schematic view of an image forming apparatus according to yet another exemplary embodiment.

As illustrated in FIG. 6, an image forming apparatus 100*b* according to another exemplary embodiment includes, as a vibrator 150*b*, a rack 157 which moves in a transverse direction with respect to a lengthwise direction of a delivery member 130, a pinion 156 which drives the rack 157 and a pinion driver (not illustrated) which drives the pinion 156.

As the pinion 156 rotates clockwise and counterclockwise, the rack 157 moves between a contact position to contact and actuate the delivery member 130 and a separation position to be spaced from the contact position. As the delivery member 130 is actuated by the vibrator 150*b*, the developer is not adhered to the delivery member 130 and may be supplied to a developing chamber C without difficulty.

Figure 7:
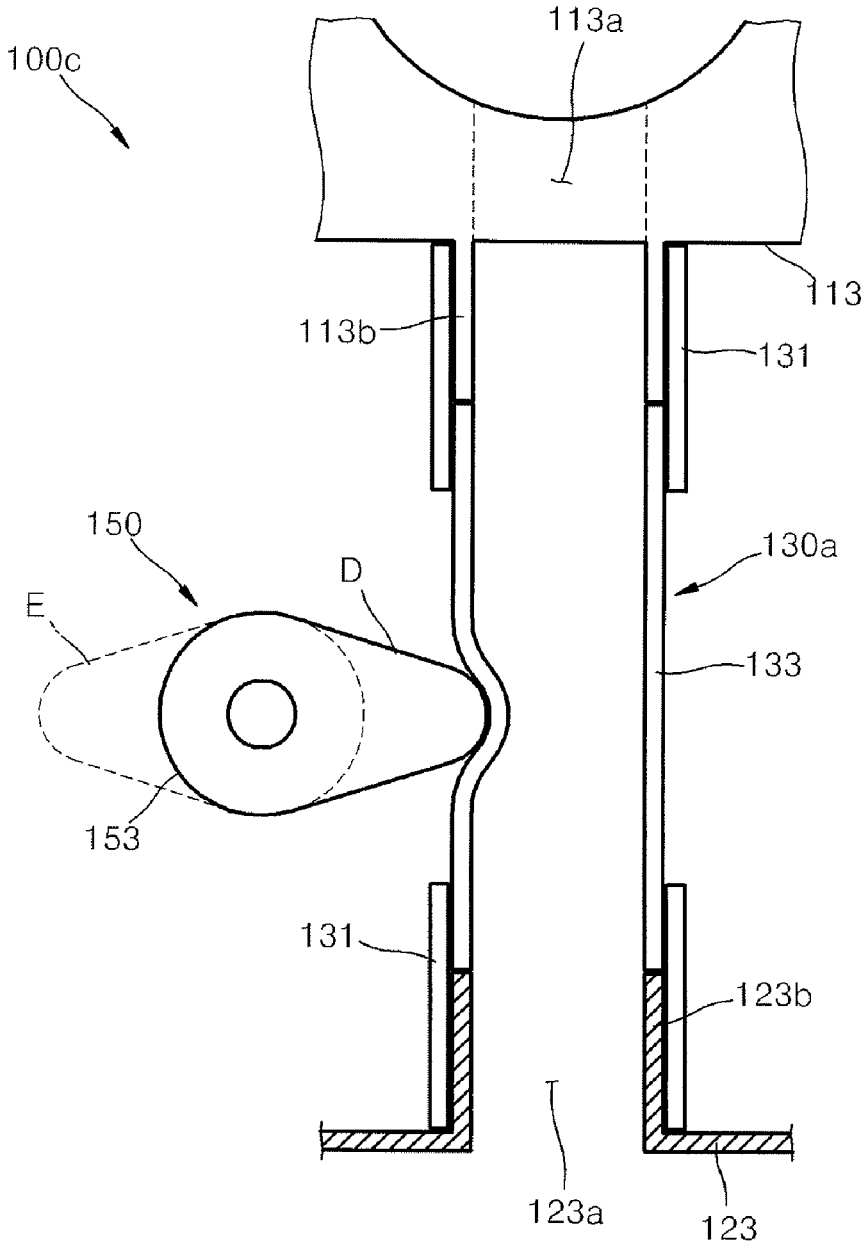
FIG. 7 is a schematic view of an image forming apparatus according to still another exemplary embodiment.

As illustrated in FIG. 7, an image forming apparatus 100*c* according to another exemplary embodiment includes a delivery member 130*a* which has a hard part 131 and a soft deformer 133.

The delivery member 130 according to the previous exemplary embodiments includes the same material as a whole. However, a delivery member 130*a* according to the present exemplary embodiment includes the hard part 131 and the soft deformer 133 which have different materials.

The hard part 131 includes a harder material than the soft deformer 133 (to be described later). As illustrated in FIG. 7, the hard part 131 is provided at opposite end parts of the delivery member 130*a* to be respectively combined with a projection 113*b* of a developer discharger 113 and a projection 123*b* of a developer receiver 123.

The soft deformer 133 includes a soft material such as rubber or soft plastic. As illustrated in FIG. 7, opposite end parts of the soft deformer 133 may be combined with the hard part 131 by an adhesive. The soft deformer 133 may be provided in a portion where a developer is excessively adhered as compared with other portions within the delivery member 130 as necessary.

A vibrator 150 is adjacent to the soft deformer 133 to apply vibration to the soft deformer 133. The vibrator 150 may move between a contact position D to contact and actuate the soft deformer 133 and a separation position E to be spaced from the contact position D. The vibrator 150 is the same as that according to the exemplary embodiment FIG. 3. Thus, a detailed description thereof will be avoided here.

As the soft deformer 133 is actuated, the developer is supplied to a developing chamber C (refer to FIG. 3) without being adhered to the delivery member 130*a*.

Figure 9A:
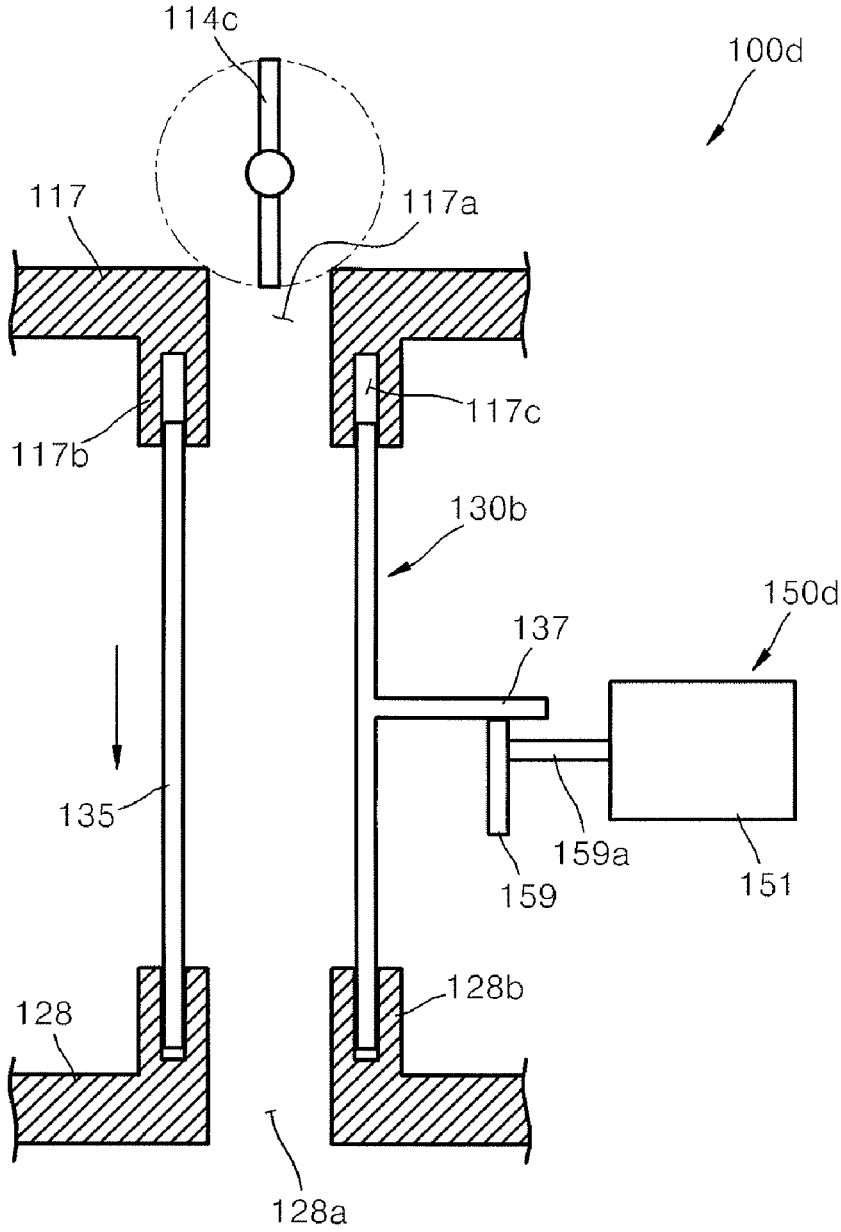
FIGS. 9A and 9B are enlarged views of main parts of an image forming apparatus according to still another exemplary embodiment.
Figure 9B:
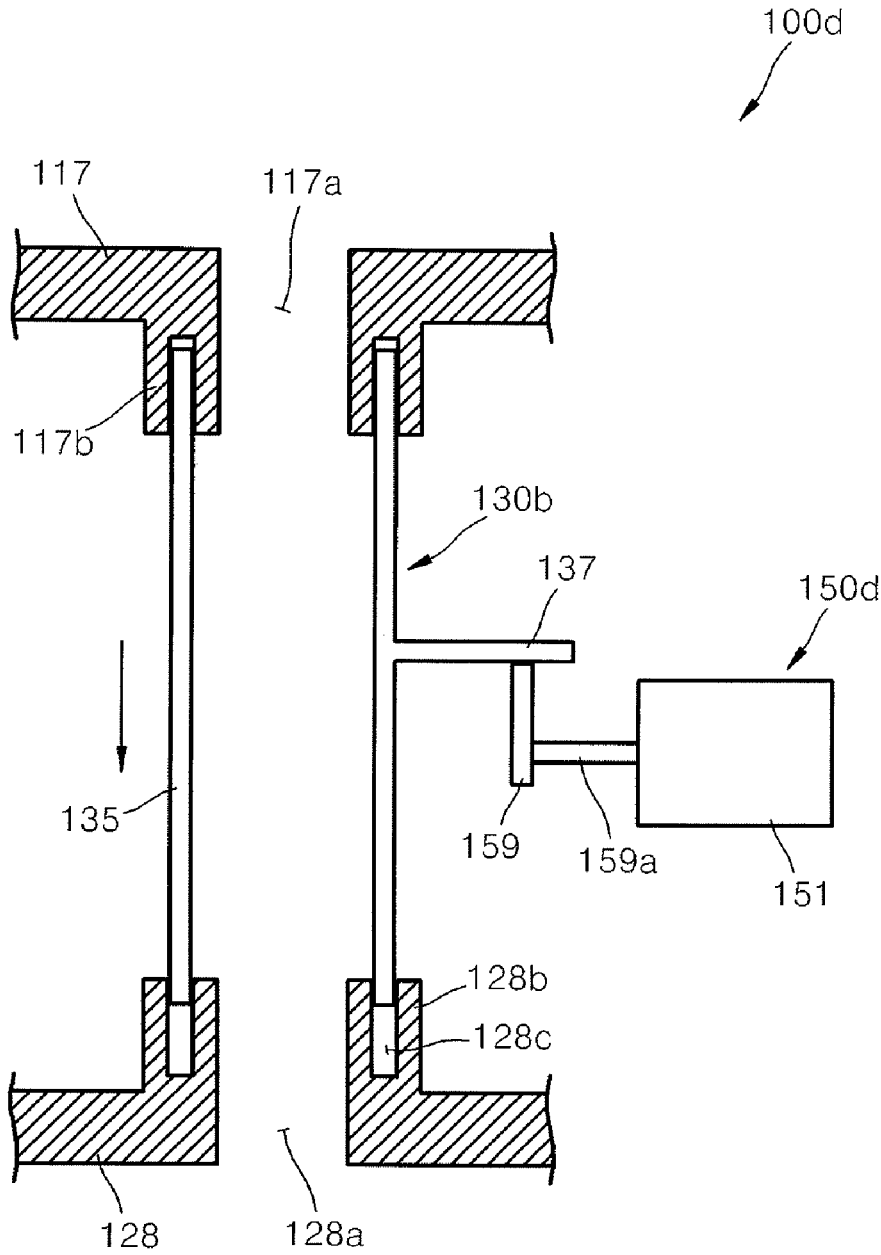

As illustrated in FIGS. 9A and 9B, an image forming apparatus 100*d* according to another exemplary embodiment includes a developer discharger 117, a developer receiver 128 and a delivery member 130*b* which connects the developer discharger 117 and the developer receiver 128 and delivers a developer.

Like in the previous exemplary embodiments, the developer discharger 117 and the developer receiver 128 are formed integrally in a developer storage tank (not illustrated) and a unit casing (not illustrated), respectively.

The developer discharger 117 may include a developer outlet 117*a* through which the developer is discharged, and a projection 117*b* which protrudes to the developer receiver 128. An insertion groove 117*c* is formed in the projection 117*b* to insert the delivery member 130*b* therein.

The developer receiver 128 may include a developer inlet 128*a* through which the developer is introduced, and a projection 128*b* which protrudes to the developer discharger 117. An insertion groove 128*c* is formed in the projection 128*b* to insert the delivery member 130*b* therein.

The opposite end parts of the delivery member 130*b* are movably inserted into the insertion grooves 117*c* and 128*c* of the developer discharger 117 and the developer receiver 128 in a lengthwise direction. The insertion grooves 117*c* and 128*c* are elongated in the lengthwise direction so that the delivery member 130*b* may move in the lengthwise direction. The insertion grooves 117*c* and 128*c* have such a length that the delivery member 130*b* is not separated from the developer discharger 117 and the developer receiver 128 even if the delivery member 130*b* moves in the lengthwise direction.

The delivery member 130*b* includes an external force accommodator 137 which protrudes in a transverse direction to the lengthwise direction. The external force accommodator 137 is in contact with and supported by an actuator 159 of a vibrator 150*d*.

The vibrator 150*d* includes an actuator driver 151 and an actuator 159. The actuator 159 may include a cam which rotates while centering around a cam shaft 159*a*. As illustrated in FIGS. 9A and 9B, the delivery member 130*b* reciprocates in the lengthwise direction as the actuator 159 rotates while centering around the cam shaft 159*a*. Accordingly, the delivery member 130*b* is actuated, thereby preventing the developer in the delivery member 130*b* from being adhered thereto.

The image forming apparatus according to the various embodiments provides the following effects.

A developer can be supplied to a developing chamber with simplicity and consistency.

The amount of the developer stored in the developing chamber can be maintained relatively constant regardless of environmental variations. Thus, printing quality is secured with uniform density.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

a developer storage tank which stores a developer therein and has a developer discharger to discharge the developer therethrough;

a developer receiver which receives the developer;

a delivery member connected with the developer discharger and to deliver the developer to the developer receiver through a delivery path;

a vibrator which vibrates the delivery member, the vibrator including:

an actuator which moves between a contact position to contact and actuate the delivery member and a separation position to be spaced from the delivery member; and an actuator driver which drives the actuator;

a developer amount detector provided in a unit casing of a developing unit to detect the amount of the developer stored therein; and a controller which controls the actuator driver to position the actuator in the separation position if the unit casing is full of the developer.

2. The image forming apparatus according to claim 1, wherein the developing unit develops a printing medium with the developer supplied to the developer receiver.

3. The image forming apparatus according to claim 2, wherein the developing unit comprises:

the unit casing; and a developing roller accommodated in the unit casing and to develop the printing medium.

4. The image forming apparatus according to claim 3, wherein the developer receiver is integrally formed in the unit casing.

5. The image forming apparatus according to claim 1, wherein the delivery member comprises a soft deformer which has a soft material and is deformed by an external force.

6. The image forming apparatus according to claim 5, wherein the vibrator vibrates the soft deformer.

7. The image forming apparatus according to claim 5, wherein the soft deformer comprises rubber or soft plastic.

8. The image forming apparatus according to claim 5, wherein the delivery member comprises a hard part which has a hard material and is connected with either the developer discharger or the developer receiver.

9. The image forming apparatus according to claim 1, wherein the delivery path is formed as a straight line.

10. The image forming apparatus according to claim 1, wherein the delivery member is detachably attached to the developer receiver and the developer discharger respectively.

11. The image forming apparatus according to claim 1, wherein the actuator comprises a cam.

12. The image forming apparatus according to claim 1, wherein the actuator comprises a rack.

13. The image forming apparatus according to claim 1, wherein the controller controls the actuator driver to periodically position the actuator in the contact position if a user commands to print.

14. The image forming apparatus according to claim 1, wherein the vibrator vibrates the delivery member to reciprocate in a lengthwise direction.

15. The image forming apparatus according to claim 3, wherein the vibrator operates simultaneously with the developing roller.

16. The image forming apparatus according to claim 1, wherein the actuator rotates in contact with the delivery member to activate the delivery member.

17. A developer transportation apparatus, comprising:

a delivery member to deliver developer from a first location to a second location through a delivery path;

an actuation member which actuates to deform the delivery member to enhance delivery of the developer therethrough;

a developer amount detector provided in a unit casing of a developing unit to detect the amount of the developer stored therein; and a controller to control the actuator member to position the actuation member in a separation position that is spaced from the delivery member if the unit casing is full of the developer.

18. The developer transportation apparatus of claim 17, where the actuation member comprises:

an actuator which moves between a contact position to contact and actuate the delivery member and the separation position to be spaced from the delivery member; and an actuator driver which drives the actuator.

19. The developer transportation apparatus of claim 18, wherein the actuator comprises a cam.

20. The developer transportation apparatus of claim 17, where the actuator comprises:

a rack which moves to contact and deform the delivery member; and a pinion gear which rotates to move the rack toward and away from the delivery member.

21. The developer transportation apparatus of claim 17, where the actuation member comprises:

an actuator which rotates in contact with the delivery member to activate the delivery member; and an actuator driver which drives the actuator.

22. An image forming apparatus, comprising:

a developer storage tank to store a developer therein and that has a developer discharger to discharge the developer therethrough;

a developer receiver to receive the developer;

a delivery member connected with the developer connected with the developer discharger and to deliver the developer to the developer receiver through a delivery path;

a vibrator to vibrate the delivery member;

a developer amount detector provided in a unit casing of a developing unit having the developer receiver to detect the amount of the developer stored therein; and a controller to control a position of the vibrator based on a detection result of the developer amount detector.

* * * * *